United States Patent [19]

Hurskainen et al.

[11] 4,180,999

[45] Jan. 1, 1980

[54] CYLINDER LOCK

[75] Inventors: Oiva Hurskainen, Joensuu; Franz Kiraly, Turku, both of Finland

[73] Assignee: Oy Wartsila AB, Helsinki, Finland

[21] Appl. No.: 924,082

[22] Filed: Jul. 12, 1978

Related U.S. Application Data

[63] Continuation of Ser. No. 727,524, Sep. 28, 1976, abandoned.

[30] Foreign Application Priority Data

Oct. 3, 1975 [FI] Finland ..... 752760

[51] Int. Cl.[2] ..... E05B 15/14; E05B 29/00

[52] U.S. Cl. ..... 70/366; 70/377

[58] Field of Search ..... 70/365, 366, 362, 376–377, 70/DIG. 28

[56] References Cited

U.S. PATENT DOCUMENTS

| | | | |
|---|---|---|---|
| 3,789,638 | 2/1974 | Roberts | 70/366 |
| 3,972,210 | 8/1976 | Toivonen | 70/366 |

*Primary Examiner*—Robert L. Wolfe

*Attorney, Agent, or Firm*—Haseltine, Lake & Waters

[57] ABSTRACT

A cylinder lock comprising a cylinder housing, a cylinder turnable therein, and in the cylinder, a plurality of locking discs turnable by the key of the lock. The locking discs are arranged in separated relation from each other by immovable intermediate walls in the cylinder. Thus, each locking disc has its own firmly fixed turning space.

6 Claims, 3 Drawing Figures

Fig. 2
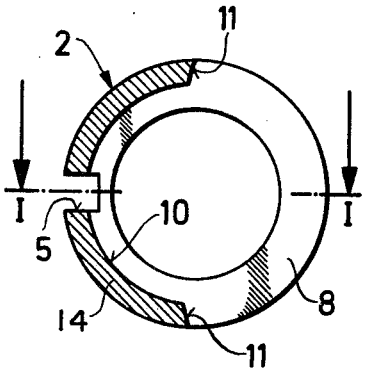
Fig. 3
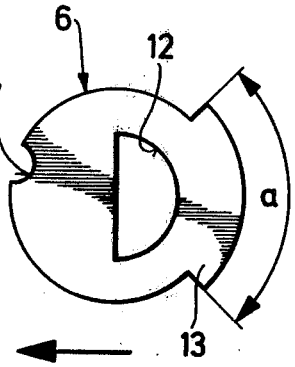
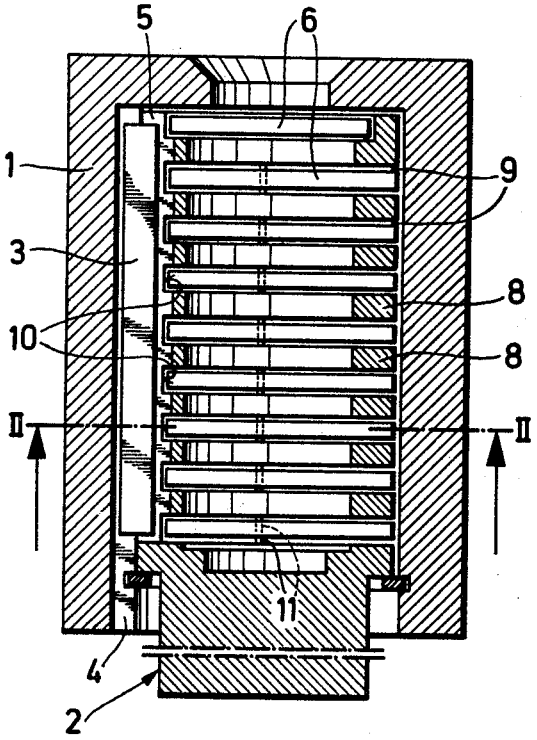
Fig. 1

CYLINDER LOCK

This is a continuation, of application Ser. No. 727,524 filed Sept. 28, 1976 and now abandoned.

FIELD OF THE INVENTION

The invention relates to a cylinder lock comprising a cylinder housing, a cylinder turnable therein, and in the cylinder, a number of locking discs turnable by the key of the lock.

BACKGROUND

In the cylinder of a disc cylinder lock, there is usually a free interior space, into which the locking discs are inserted in an axial direction of the cylinder. Between the locking discs, non-turnable, separate intermediate discs are placed, with the object of preventing the turning movement of one locking disc from being transmitted to an adjacent locking disc by friction. However, the use of intermediate discs in the locking disc set causes some considerable disadvantages. The number of parts to be manufactured increases, the locking disc set becomes somewhat elastic and the smallest possible diameter of the lock is at least partly dependent in particular on the intermediate discs. Additionally, it is very difficult to fill mechanically the cylinder of the lock, since locking discs as well as intermediate discs are to be inserted into the lock.

SUMMARY OF THE INVENTION

An object of the invention is to provide a lock, in which the above disadvantages have been eliminated and which is particularly well suited for being automatically filled with locking discs. The invention is characterized in that the cylinder is so formed that between adjacent locking discs there is an immovable intermediate wall. The immovable intermediate walls exactly determine the position of each locking disc and hence, the manufacturing of the key is simplified and the working reliability of the lock is improved. Additionally, the cylinder is especially suitable for being automatically filled up, because each locking disc has its exactly determined position, wherein it can be placed from the side of the cylinder. Due to the invention, also the pick-proofness of the lock becomes still better.

The insertion of each locking disc in its own separate moving space is known per se in such cylinder locks, where the locking discs move radially. The working principle of these locks, however, considerably deviates from the working principle of a rotating-disc cylinder lock furthermore, with respect to the manufacturing operations, the occuring problems are different. In spite of the fact that disc cylinder locks, where the locking discs are turned into release-position, have been known for about 60 years, there has never been used before, in this type of lock, a construction where each locking disc has its own firmly fixed turning space.

In a lock according to the invention, it is of advantage that the outer dimension of the intermediate walls of the cylinder corresponds at least substantially to the outer dimension of the cylinder. The manufacture of such a cylinder is somewhat more difficult than, for instance, the manufacture of a cylinder which is either divided into two parts along an axial central plane, or in which one half of the cylinder has been completly milled off. However, it is essential that the locking discs are supported axially mainly all around their edge portion, and hence, it is advisable that the intermediate walls are shaped in accordance with this principle.

The most favorable solution is that the circumferential portion of the cylinder is removed at the positions of the locking discs from approximately one half of the cylinder. Other solutions are also feasible, but then it is necessary to use divided locking discs or other solutions unfavourable with regard to manufacturing practice.

In a rotating-disc cylinder lock, a locking bar is used to lock the cylinder relative to the immovable cylinder housing. A slot for the locking bar is provided in the cylinder, whereby in a lock according to the invention, the most favorable solution is to arrange this slot substantially in the middle of the uncut half of the cylinder, that is, diametrically opposite the opened half of the cylinder. Thus, the best possible solution with respect to the structural strength is obtained.

There is in the cylinder at the positions of the locking discs, an opening of about 180°, and the turnable locking discs of the lock are provided with such a turning limiting protrusion that the free turning angle of the locking discs will be of a suitable magnitude. In a disc cylinder lock, the free turning angle of a locking disc is usually 90°, and hence, in such a case the width of the turning limiting protrusion should be about 90°.

When manufacturing a lock according to the invention, it is important to use a well outlined manufacturing method in order to obtain an economical and reliable result. The method for manufacturing the cylinder of the type of lock referred to, is characterized in that a hollow cylinder is first cut open from the side, preferably by milling, at least substantially to a central plane of the cylinder, or further, leaving portions between the positions of the locking discs uncut, and that thereafter interior grooves for the locking discs are formed in the hollow portion of the cylinder. By this method a good chip removal is obtained, which is likely to improve the quality of the cutting. It is of advantage to make the openings cut from the side so much broader than the interior grooves, which are turned out for the locking discs, that reasonable manufacturing tolerances can be used. A suitable width difference is, for instance, 0.1 mm. By turning the grooves as well as by milling them open, it is of advantage to use a multi-cutter, by means of which all areas which are to be cut are milled or, respectively, turned simultaneously. In the manufacture, the aim should be to obtain such tolerances that the positions of the locking discs are determined in an axial direction of the lock with an accuracy of $\pm 0.1$ mm and the thickness of the locking discs is determined with an accuracy of $\pm 0.03$ mm.

Other advantageous methods of manufacture are to make the cylinder either of plastic by an extrusion process or of zinc by means of die casting. In those cases cutting is not necessary.

BRIEF DESCRIPTION OF THE DRAWINGS

In the following, the invention is described in greater detail with reference to the enclosed drawing, in which FIG. 1 shows a lock according to the invention in axial section, FIG. 2 is a cross-section taken on line II—II in FIG. 1 of the cylinder of the lock, and FIG. 3 is a plan view of a locking disc of the lock according to the invention.

DETAILED DESCRIPTION

In the drawing, 1 indicates the cylinder housing of the lock and 2 the turnable cylinder of the lock. By the term "turnable cylinder" is meant that part of the lock which is directly locked to the cylinder housing by means of a locking element such as locking bar 3. Namely, between the cylinder 2 and the cylinder housing 1 there is locking bar 3 which, in the locking position of the lock, is partly located in a groove 4 in the cylinder housing and partly in a slot 5 in the cylinder. Inside the cylinder there is a number of locking discs 6 which are turned by the key of the lock into a position releasing the cylinder, whereby notches 7 (FIG. 3) in the outer edge of the locking discs line up at the position of the locking bar 3, so that the locking bar can move radially inwards away from the groove 4 in the cylinder housing.

The cylinder 2 of the lock is provided with immovable walls 8 determining for each locking disc 6 a space 9 where it can move. The intermediate walls can be made by first boring the cylinder so that it becomes hollow. Thereafter, one half of the cylinder is milled open so that the cylinder body at the positions of the locking discs 6 does not exceed the line 11, which is approximately in a central plane of the cylinder. Finally, grooves 10 for each locking disc are turned in the inner surface of the cylinder to leave part-annular wall portions 14 connecting adjacent walls 8. Since the cylinder is now open on one half thereof, the locking discs can be inserted into the cylinder from the side, in FIG. 2 from the right. means of a suitable feeding device the filling of the cylinder can easily be performed automatically.

FIG. 3 shows a locking disc 6 of a lock according to the invention, which disc in its central portion has a semi-circular opening 12 for a key. At the edge of the locking disc there is a notch 7 for the locking bar. In some locking discs there may be several of these notches. The locking disc is also provided with a protrusion 13 with the object of limiting the free turning angle of the locking disc. The protrusion 13 covers a sector a of about 90°. Hereby, the turning angle of the locking disc of the shown lock will be about 90°. The protrusion 13 also serves to center the disc by means of the inner surface of the cylinder housing 1.

The invention is not limited to the shown embodiment, but several modifications of the invention are feasible within the scope of the attached claims.

We claim:

1. A cylinder lock comprising a cylinder housing, a hollow cylinder turnable in said housing, a locking bar movable in a slot provided in the wall of said hollow cylinder between (a) a locking position, in which said locking bar extends partly outside the outer surface of said cylinder and is partly received in a recess provided in said cylinder housing, thereby locking the turning movement of said cylinder relative to said cylinder housing, and (b) a releasing position in which said locking bar has moved radially inwardly relative to said cylinder housing and out from said recess, said cylinder lock further comprising a plurality of separate and independent locking discs having key engaging means so as to be turnable by a key of the lock, said cylinder including spaced immovable partition walls between which respective locking discs are rotatably received, said walls being in rigid connection with said cylinder, said cylinder having openings between said partition walls, said openings allowing insertion of said locking discs into said cylinder from one side thereof, said cylinder having integral part-annular wall portions joining adjacent partition walls, said integral part-annular wall portions having inner surfaces rotatably supporting the locking discs, said locking discs each including a radial protrusion for centering said locking disc by means of the inner surface of said cylinder housing at said openings between said partition walls.

2. A lock according to claim 1 wherein said openings between said partition walls are at that side of said cylinder which is opposite the slot for said locking bar.

3. A lock according to claim 1 wherein said annular walls have end surfaces which cooperate with said radial protrusions of said locking discs for limiting the turning movement of said locking discs.

4. A lock according to claim 1, in which the outer circumference of said partition walls is at least substantially coincident with the outer circumference of the cylinder.

5. A lock according to claim 1, in which said hollow cylinder is open at the positions of said locking discs over approximately one half of the circumferential of the cylinder.

6. A lock according to claim 5, in which the angular extent of the radial protrusion in the circumferential direction of the locking discs covers about 90°.

* * * * *